United States Patent [19]

Hamada et al.

[11] Patent Number: 4,775,589

[45] Date of Patent: Oct. 4, 1988

[54] COALTAR PITCH BASED CARBON FIBER HAVING HIGH YOUNG'S MODULUS

[75] Inventors: Takeshi Hamada; Tokuhiko Nishida; Yasunori Sajiki; Mitsuaki Matsumoto, all of Kawasaki, Japan

[73] Assignees: Nippon Steel Cporporation; Nippon Chemical Co., Ltd., both of Tokyo, Japan

[21] Appl. No.: 880,976

[22] Filed: Jul. 1, 1986

[30] Foreign Application Priority Data

Jul. 2, 1985 [JP] Japan ..... 60-144036
Jun. 6, 1986 [JP] Japan ..... 61-130192

[51] Int. Cl.[4] ..... B32B 9/00; D01F 9/12; D02G 3/00

[52] U.S. Cl. ..... 428/367; 423/447.1; 423/447.2; 428/397; 264/29.2

[58] Field of Search ..... 428/367; 423/447.1, 423/447.2, 447.4, 447.6, 447.8; 264/29.2

[56] References Cited

U.S. PATENT DOCUMENTS 4,005,183 1/1977 Singer ..... 423/447.4
4,331,620 5/1982 Diefendorf et al. ..... 264/29.2
4,504,454 3/1985 Riggs ..... 423/447.2

FOREIGN PATENT DOCUMENTS 2129825 5/1984 United Kingdom .

OTHER PUBLICATIONS

Diefendorf et al., Polymer Engineering and Science, 15, No. 3, 150 (1975).
Ruland, Applied Polymer Symposia, No. 9, 293 (1969).
White et al., Preprint for Am. Chem. Soc. Symp. on Petroleum Derived Carbon, 29, No. 2, 388 (1986).
Hishiyama et al., "Carbon", 18, No. 6, 427–432 (1980).

*Primary Examiner*—Lorraine T. Kendell
*Attorney, Agent, or Firm*—Pollock, Vande Sande Priddy

[57] ABSTRACT

This invention relates to a coaltar pitch based carbon fiber having a high Young's modulus produced by using coaltar pitch as a starting material, which has a microstructure with a preferred orientation parameter (HWHM) of 10° or less, a crystallite size (Lc(002)) of not more than 25 nm and not less than 18 nm and an interlayer spacing (d002) of not more than 0.345 nm and not less than 0.338 nm as determined by X-ray diffraction, and has a magnetoresistance of less than −0.40% and not less than −2.00% as measured by applying a magnetic field of 10 KG perpendicular to the fiber axis at liquid nitrogen temperature, and a Young's modulus of 55 ton·mm$^{-2}$ or more, preferably 75 ton·mm$^{-2}$ or more. The carbon fiber of this invention has a high Young's modulus, is flexible, and does not split in the fiber axis direction, and therefore it is easy to handle, is good in workability, and contributed also to improvement of the production efficiency. Further, when the carbon fiber of this invention is used in composite material, the resulting composite material can be expected to have an improved impact strength and hence can be used for various purposes.

7 Claims, 3 Drawing Sheets

COALTAR PITCH BASED CARBON FIBER HAVING HIGH YOUNG'S MODULUS

FIELD OF THE INVENTION

The present invention relates to a novel coaltar pitch based carbon fiber. More particularly, the present invention relates to a novel carbon fiber which is produced by using as a starting material mesophase pitch obtained from coaltar pitch and has high Young's modulus.

BACKGROUND OF THE INVENTION

In recent years, with the rapid growth of aircraft space and missile industries and the like, materials having extraordinary excellent mechanical properties have been needed. Further, as materials for sporting goods, particularly those of high quality, there have come to be desired materials which are lighter and have superior mechanical properties as compared with conventional materials.

Since these materials are required to have high strength, high Young's modulus and light weight, the search for materials now appears to be concentrated upon composite materials.

One of the most hopeful materials suggested as a constituent of composite materials was carbon fibers having high strength and high Young's modulus. Such carbon fibers were incorporated into plastics and metal matrixes to give composite materials having very high strength, and high modulus-to-weight ratio, and other special properties. However, the high production cost of the carbon fibers having high strength and high Young's modulus used as constituent of such composite materials is a serious obstacle to wide use of the carbon fibers though the composite materials have excellent characteristics.

Most carbon fibers having high strength and high Young's modulus which are now available are derived from acrylic fibers, and are intrinsically expensive because precursors of the acrylic fibers are expensive. In addition to the expensiveness of the starting materials, a low carbon yield (about 45%) attained from such precursors and a complicated production process raise the price of the final product.

Further, such PAN based carbon fibers not only require a high cost but also are disadvantageous in that though they can be easily given a high strength, they cannot easily be given a high Young's modulus and require an additional special treatment step for giving them high Young's modulus.

On the other hand, as carbon fibers used in place of such PAN based carbon fibers, pitch based carbon fibers have come to noted because of their low material cost, high carbon yield and the like.

In the case of the pitch based carbon fibers, pitches obtained from coal, petroleum and the like are used as starting materials. When the precursor pitch is a so-called mesophase pitch containing 40% or more, preferably 80% or more of mesophase, the resulting carbon fibers can have high Young's modulus.

It is common knowledge that high Young's modulus of pitch based carbon fiber can be attained by promoting its graphitization, and a typical pitch based carbon fiber having high Young's modulus obtained by applying this principle and a process for producing the same are disclosed in Japanese Patent Kokai (Laid Open Publn) No. 19127/74. Such a pitch based carbon fiber has a strength of 210 kg·mm$^{-2}$, a Young's modulus of 70 ton·mm$^{-2}$ and an elongation of 0.3%, and a preferred orientation parameter (HWHM) of 5° or less, a crystallite size ($L_c$(002)) of 100 nm or more and an interlayer spacing (d002) of 0.337 nm or less as determined by X-ray diffraction, a electrical resistivity of $2.5\times10^4\cdot\Omega\cdot$.cm or less, and an X-ray diffraction pattern characterized by the presence of the (112) line and resolved (100) and (101) lines and thereby it is shown that in the carbon fiber, graphite crystallite are grown three-dimensionally, namely, in both the fiber axis direction and a direction of section perpendicular to the fiber axis. When the graphite crystallite are grown three-dimensionally, the magnetoresistance is generally positive.

However, carbon fibers having a high degree of three-dimensional graphitization and a high Young's modulus besides the carbon fiber described above are also said to have two defects.

One of the defects is that though such carbon fibers have a high Young's modulus, they are very brittle. Here, the term "brittleness" means brittleness against forces other than tensile force, for example, torsional stress and stress in a direction perpendicular to fiber. One cause of such brittless seems to be an increase of the cleavage of graphite crystallites with their three-dimensional growth.

What is important here is as follows. According to the analysis results obtained by the present inventors, the Young's modulus increases with a growth of graphite crystallites in the fiber axis direction, namely, a decrease of the preferred orientation parameter (HWHM) determined by X-ray analysis, but the growth of graphite crystallites in a direction of section perpendicular to the fiber axis to give a three-dimentional structure, resulting in a large crystallite size (Lc(002)), a small interlayer-spacing (d002), and a positive high magnetoresistance, makes no contribution to the Young's modulus and further embrittles the carbon fibers.

However, it is not easy to overcome such brittleness without lowering the Young's modulus of a pitch based carbon fiber. This is because it is generally difficult to control the growth of graphite crystallites in the fiber axis direction and that in a direction of section perpendicular to the axis independently of each other.

The second defect of the carbon fibers having three-dimensionally grown graphite crystallites is that when they are spun into fibers by a conventional method, the structures of section perpendicular to the axis of each carbon fiber tend to be of a so-called radial type in which molecules are aligned facing in the direction of the center of the section, so that the carbon fibers become liable to split longitudinally along the fiber axis direction with a growth of graphite crystallites in the section direction. Needless to say, such carbon fibers are greatly lowered in commercial value by the split.

Here, the second defect can be overcome either by changing the section structure of radial type to a section structure of another type, or by depressing the growth of graphite crystallite in a direction of section perpendicular to the fiber axis. In practice, the former is easy, and therefore processes for producing a carbon fiber having a section structure of a type other than radial type is investigated without considering the latter.

For example, as disclosed in Japanese Patent Koakai (Laid Open Publn) Nos. 76925/84 and 53717/84, such processes comprise raising spinning temperature and thereby obtaining a section structure of random type or onion type.

Carbon fibers produced by these conventional processes have a section structure of a type other than radial type and hence can overcome the second defect, i.e., the split, sufficiently. However, they can not overcome the first defect, i.e., the brittleness. The reason for this is as follows. In order to overcome the first defect, the brittleness, the growth of graphite crystallites in a direction of section perpendicular to the fiber axis should be depressed sufficiently though graphite crystallites are satisfactorily grown in the direction of fiber axis of the carbon fiber. For this, molecules constituting pitch should be satisfactorily oriented in the fiber axis direction at a pitch fiber stage, and in the section direction domains where such molecules are oriented in the same direction should be subdivided. According to conventional spinning methods, subdivision of such domains in the section of pitch fiber is not conducted sufficiently, so that a carbon fiber obtained by heat-treating the pitch fiber has three-dimensionally grown graphite crystallite. Therefore, though the second problem, the split could be solved, the first problem, the brittleness has not yet been able to be overcome.

SUMMARY OF THE INVENTION

The object of this invention is to provide a coaltar pitch based carbon fiber which is obtained by using a mesophase pitch as starting material, is free from both of the two defects conventionally possessed by the above-mentioned pitch based carbon fibers having a high Young's modulus, namely, the defect of brittleness and the defect of split, and has a high Young's modulus. More particularly, this invention relates to a carbon fiber produced by using coaltar pitch as a starting material, which is characterized by having a microstructure with a preferred orientation parameter (HWHM) of 10° or less, a rrystallite size (Lc(002)) of not more than 25 nm and not less than 18 nm, and an interlayer spacing (d002) of not more than 0.345 nm and not less than 0.338 nm as determined by X-ray diffraction, and having a magnetoresistance of less than −0.40% and not less than −2.00% as measured by applying a magnetic field of 10KG perpendicularly to the fiber axis at liquid nitrogen temperature, and a Young's modulus of 55 ton·mm$^{-2}$ or more (preferably 75 ton·mm$^{-2}$ or more).

DETAILED DESCRIPTION OF THE INVENTION

The present inventors have found that for a carbon fiber which has a high Young's modulus (55 ton·mm$^{-2}$ or more, preferably 75 ton·mm$^{-2}$ or more), is flexible, and does not split in the fiber axis direction, the important things are growth of graphite crystallites in the fiber axis direction, satisfactory degree of preferred orientation, and depression of growth of graphite crystallites in the direction of section perpendicular to the fiber axis. This fact is expressed in terms of physical property values as follows. Said carbon fiber is one which is produced by use of coaltar pitch as a starting material, and has a small preferred orientation parameter (HWHM) (10° or less), a small crystallite size (Lc(002)) (not more than 25 nm and not less than 18 nm) and a large interlayer spacing (d002) (not more than 0.345 nm and not less than 0.338 nm) as determined by X-ray diffraction, and a low magnetoresistance (less than −0.40% and not less than −2.00%).

The preferred orientation parameter (HWHM) of the coaltar pitch based carbon fiber should be 10° or less for exhibition of a Young's modulus. When the crystallite size and the interlayer spacing are more than 25 nm and less than 0.338 nm, respectively, the carbon fiber became brittle.

When the magnetoresistance is positive, the carbon fiber becomes brittle. When the magnetoresistance is less than −0.40% it is possible to prevent interlayer cleavage and bring out the flexibility of the carbon fiber, as much as possible only by adjusting the magnetoresistance to less than −0.40%.

When a carbon fiber having a high Young's modulus is attempted to be obtained by a conventional spinning method, graphite crystallites grow not only in the fiber axis direction but also in the section direction. Therefore, its graphite layers are increased in flatness to form a structure in which the carbon layers are regularly placed one upon another (a three-dimensional structure). Accordingly, in general, Lc becomes more than 25 nm, (d002) becomes less than 0.338 nm, and the magnetoresistance becomes positive. Such a carbon fiber is brittle.

On the basis of an idea that in order to obtain carbon fiber in which such growth of graphite crystallites in a direction of section perpendicular to the fiber axis direction is depressed, it is necessary that at a pitch fiber stage, domains where molecules are aligned in the same direction should be subdivided in the section, the present inventors have conducted various technical researches, and have accomplished this invention.

In detail, in order to first investigate at which stage of spinning of a precursor pitch and in what manner the section structure perpendicular to the fiber axis of a carbon fiber is determined, the present inventors observed the section structures of pitch fiber, "extruded thread", and pitch right above a capillary of nozzle by using a reflecting polarization microscope.

As a result of the observation under a reflecting polarization microscope, the present inventors have found that surprisingly, the cross-section structures of pitch fiber, "extruded thread" and pitch right above a capillary of nozzle correspond to one another similarly.

Here, the "extruded thread" was obtained by spontaneous dropping of precursor pitch extruded from a nozzle (of which diameter was about 0.1 mm–0.3 mm). The pitch right above a capillary of nozzle was obtained by cooling the whole of a spinning nozzle rapidly while extruding the precursor pitch from a nozzle, thereby solidifying the precursor pitch, and collecting the solidified pitch. The pitch fiber was obtained by stretching and thinning the pitch extruded, under the nozzle.

BRIEF DESCRIPTION OF THE DRAWINGS

FIGS. 1(A), (B) and (C) are schematic views of the section structures in a direction perpendicular to the fiber axis of pitch fiber, carbon fiber and the like. FIG. 1(A) shows a quasi-onion type, FIG. 1(B) a random type, and FIG. 1(C) a radial type.

Figure 1:
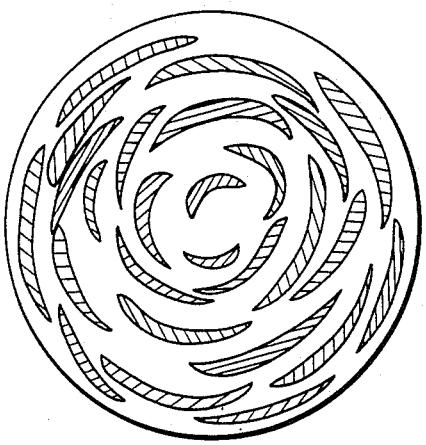
Figure 1:
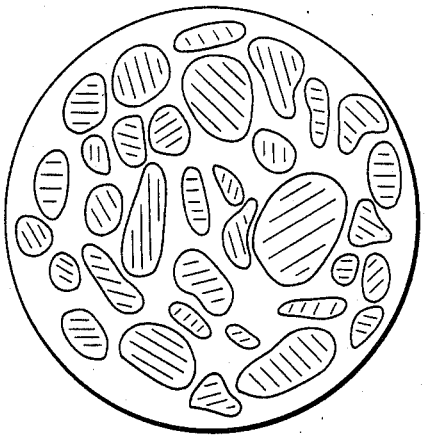
Figure 1:
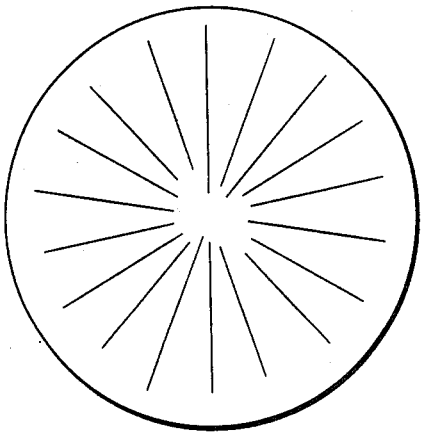

In the above drawings, numeral 1 shows molten pitch in the upper part of a nozzle, numeral 2 a capillary, numeral 3 pitch fiber, numeral 4 molten pitch right above the capillary, numeral 5 a "extruded thread", numeral 6 a drum, numeral 7 a stirrer, and numeral 8 a nozzle.

The observation results obtained by the present inventors are further explained in more detail with reference to the drawings.

Figure 3:
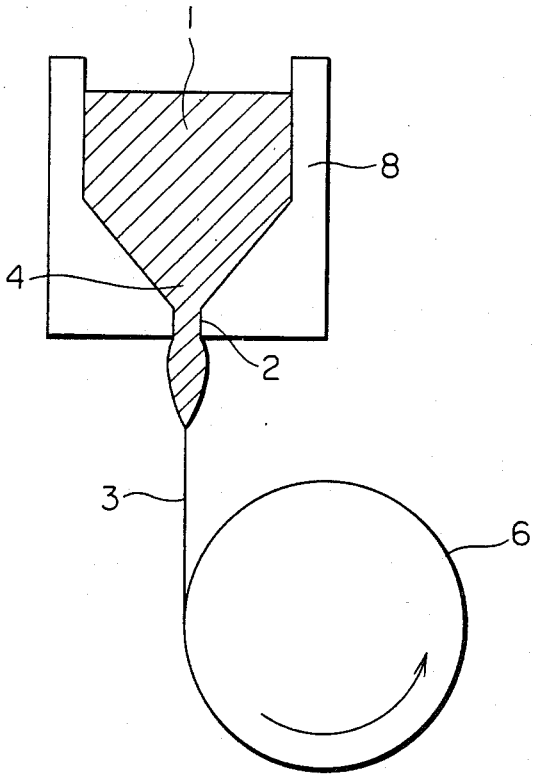
Figure 3:
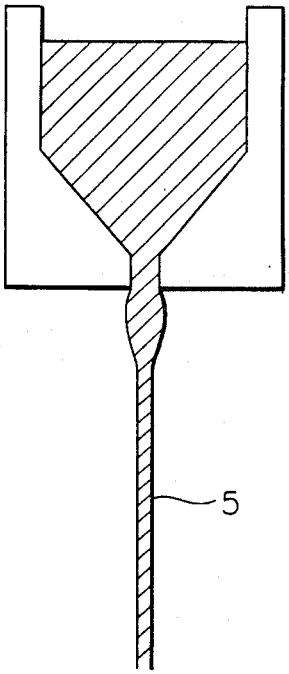

FIGS. 3(A) and (B) show a fundamental method of conventional melt spinning of pitch, which comprises extruding molten pitch 1 stored in a nozzle 8 through a capillary 2, elongating the extruded pitch under the nozzle at a high speed, and thereby producing pitch fiber 3. In this case, the section structures in a direction perpendicular to the fiber axis of the pitch right above capillary 4, the "extruded thread" 5 and pitch fiber 3 were observed by use of a reflecting polarization microscope, all of their molecular structures were of the radial type schematically shown in FIG. 1(C), and corresponds to one another similarly.

Figure 2:
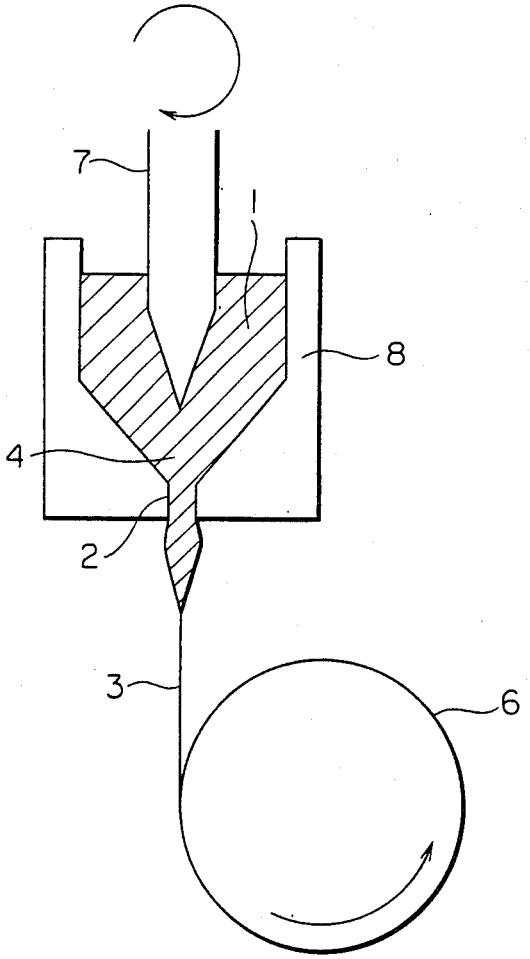
FIGS. 2(A) and (B) are elevational illustrations of a spinning nozzle with stirrer, and FIGS. 3(A) and (B) are elevational illustrations of a conventional spinning nozzle of prior art.
Figure 2:
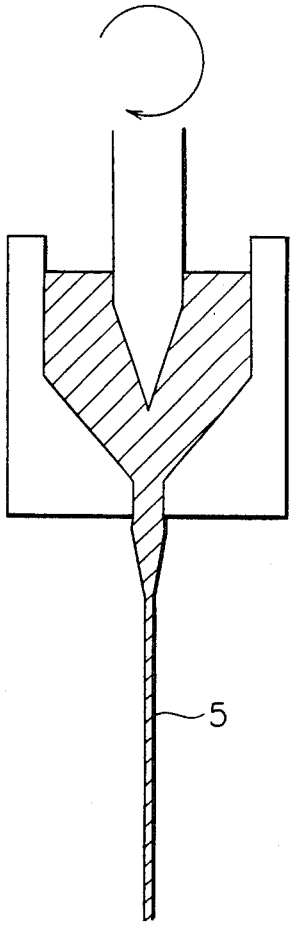

Subsequently, the present inventors stirred, as shown in FIGS. 2(A) and (B), molten pitch 1 (viscosity at spinning: 250 poises) in a nozzle 8, above a capillary by means of a stirrer 7 to disturb the flow of the molten pitch in the nozzle toward the capillary or to produce a new flow (a whirlpool-like flow in the circumferential direction above the capillary), extruded the molten pitch 1 under this condition, sampled pitch fiber 3, "extruded thread" 5, and pitch 4 right above capillary in the manner described above, and observed their cross-section structures by using a reflecting polarization microscope.

As a result, it was found that all of the cross-section structures of the three were of the quasi-onion type schematically shown in FIG. 1(A) and corresponded to one another similarly.

The term "section structure of quasi-onion type" used herein means a structure in which regions where molecules are aligned in the same direction are distributed drawing a swirl in the manner of coaxial circles, in a section in a direction perpendicular to the axis of fiber. This cross-section structure has not been found before, and though it shows an aspect entirely different from that of the conventionally known onion type in a reflecting polarization microscopic observation, resembles the onion type when it is made infusible, heat-treated and then subjected to observation of cross-section structure under a scanning electron microscope (SEM). Therefore, this type of said section structure was named "quasi-onion type".

Further, as shown in FIGS. 2(A) and (B), molten pitch (viscosity at spinning: 1,000 poises) in the nozzle was stirred above the capillary by means of the stirrer to disturb the flow of the molten pitch in the nozzle toward the capillary, and under this condition, the molten pitch was extruded. Pitch fiber, "extruded thread" and pitch right above the capillary were sampled in the manner described above, and their section structures were observed under a reflecting polarization microscope.

As a result, it was found that all of these three sectional structures are of the random type schematically shown in FIG. 1(B) and corresponded to one another similarly.

From the above finding, it was found that a cross-section structure which appeared in pitch fiber was determined by the flow above a capillary or the state of pitch, and was not essentially changed by a subsequent step, i.e., the flow in the capillary or the stretching after a nozzle, which merely made the whole structure fine similarly.

It was also confirmed by observation using a reflecting polarization microscope, a scanning electron microscope (SEM) and the like that the macroscopic or microscopic structure of a pitch fiber was inherited by a carbon fiber obtained by making the pitch fiber infusible, followed by heat treatment.

Carbon fibers obtained by making pitch fibers having such a cross-sectional structure of quasi-onion type or random type infusible, followed by heat treatment, do not undergo split along the fiber axis observed for conventional carbon fibers having a cross-section structure of radial type.

Further, domains where molecules are aligned in a definite direction in a cross-section of the pitch fiber spun with stirring the pitch above the capillary of the nozzle, are subdivided. This is because such domains have been already subdivided by the stirring in a portion having a large cross-sectional area in the upper part of the capillary, so that when the cross-sectional area is reduced by subsequent stretching, such domains become very small. The effect of subdivision of such domains becomes marked when the viscosity at spinning is high, preferably 200 poises or more and the spinning is conducted with stirring. Such an effect cannot be obtained by conventional methods.

The carbon fiber of this invention has graphite crystallites satisfactorily grown in the fiber axis direction, and for obtaining such a carbon fiber, it is necessary that at the pitch fiber stage, molecules constituting the pitch are regularly aligned in the fiber axis direction. The present inventors have ardently investigated which step in the spinning mainly contributes to such orientation of molecules in the fiber axis direction, and have consequently found that the stretching step after the nozzle is far superior in such an effect to the other steps in the spinning, namely, the flow above the capillary of the nozzle and the flow in the capillary. Therefore, whether stirring is conducted or not, the degree of orientation of pitch molecules in the fiber axis direction of a pitch fiber obtained by spinning at a draft ratio of 10 or more is the same.

As the precursor pitch used in this invention, anyone may be used so long as it is a mesophase pitch obtained from coaltar pitch. There may be used either those obtained by hydrogenation by various methods, followed by heat treatment, or those obtained by heat treatment without hydrogenation. Further, there may be used either those which lose their mesophase portions when heated to a high temperature, or those which do not lose said portions. However, in order that a carbon fiber to be finally obtained may have high Young's modulus, mesophase pitch having a mesophase content of 75% or more, preferably 90% or more is selected.

Such precursor pitch is spun by spinning with stirring in the manner described above into pitch fiber in which domains where molecules are aligned in a definite direction in a section in a direction perpendicular to the fiber axis are effectively subdivided, and molecules are satisfactorily oriented in the fiber axis direction. The pitch fiber is heated to about 250° – 350° C. in oxygen-containing gas to be made infusible, whereby infusible fiber is obtained. The infusible fiber is heat-treated in inert gas at a so-called graphitization temperature, for example, 2,000° C. or higher, whereby the carbon fiber of this invention can be obtained.

The coaltar pitch based carbon fiber thus obtained does not involve the problem of its split at all for the following two reasons: growth of graphite crystallite in the cross-section direction is depressed, and the cross-section structure is of quasi-onion type or of random type.

Further, the preferred orientation parameter (HWHM) was as small as 10° or less as determined by X-ray diffraction, and graphite crystallites are grown in the fiber axis direction, so that the Young's modulus is as high as 55 ton·mm$^{-2}$ or more, preferably 75 ton·mm$^{-2}$ or more. On the other hand, the crystallite size (Lc(002)) is as small as not more than 25 nm and not less than 18 nm, the interlayer spacing (d002) is as large as not more than 0.345 nm and not less than 0.338 nm, and the magnetoresistance is as low as less than −0.40% and not less than −2.0%. This indicates that the growth of graphite crystallite is depressed in a direction of section perpendicular to the fiber axis.

In such a carbon fiber, the layers are very finely undulant when observed from the cross-section direction, and by virtue of this fact, the defect of brittleness can be overcome. Further, by virtue of said fact, the tensile strength is also improved as compared with the case where the undulation of the layers is not fine, and the carbon fiber can easily exhibit a tensile strength of 250 kg·mm$^{-2}$ or more. Since, tensile strength, as well as flexibility, is also an important factor in handling and in the case of using carbon fibers in composite materials, the coaltar pitch based carbon fiber of this invention is particularly advantageous.

A. A. Bright and L. S. Sirger have investigated petroleum pitch based carbon fibers (Carbon, 17, p59, (1979)).

In this work, it is shown that carbon fibers having random structure heat treated at 2500° C. have a prefered orientation parameter (HWHM) of 5°, a crystallite size (Lc(002)) of 17 nm, an interlayer spacing (d002) of 0.3390 to 0.3398 nm and a Young's modulus of about 55 ton·mm$^{-2}$, and hence it may be said that like in the carbon fiber of this invention, graphite crystallites are grown in the axis direction and their growth is depressed in the cross-section direction.

However, the tensile strength of these petroleum pitch based carbon fibers is as low as about 200 kg mm$^{-2}$ as compared with that of the coaltar pitch based carbon fiber of this invention of 250 kg·mm$^{-2}$. As to the magnetoresistance, the minimum of transverse magnetoresistance under the conditions of a magnitude of magnetic field of 14KG and a temperature of 4.2K. is −2.5% for the petroleum pitch based carbon fibers, while it is −2.8% or less for the coaltar pitch based carbon fiber of this invention under the same measurement conditions.

Further, when the coaltar pitch based carbon fiber of this invention is heat treated at 3,000° C., its transverse magnetoresistance under the condition of a magnitude of magnetic field of 14KG and a temperature of 4.2K. is negative, while when the above-mentioned petroleum pitch based carbon fibers having a random structure of Bright et al. are heat treated at 3,000° C., their transverse magnetoresistance becomes +4.0%.

Such differences in physical properties are, of course, due to differences in structure.

In this sense, it may safely be said that magnetoresistance shows the structural characteristics of carbon fibers which cannot be revealed by X-ray diffraction method. Such differences seem to be attributable to differences in starting material and in spinning conditions.

However, it has been impossible to attain an interlayer spacing (d002) of more than 0.345 nm, a crystallite size (Lc(002)) of less than 18 nm and a magnetoresistance of less than −2.00% while maintaining the Young's modulus at 55 ton·mm$^{-2}$. It seems that when the degree of graphitization is lowered to such a level and the disorder in the cross-section direction is too serious, the disorder spreads also in the fiber axis direction, so that no high Young's moleculus can be exhibited.

Thus, the carbon fiber of this invention is a quite novel coaltar pitch based type carbon fiber which has a high Young's modulus and is free from both the problem of brittleness and the problem of split.

Next, there are described below the various physical values used for expressing characteristics of the coaltar pitch based carbon fiber and the coaltar pitch of the present invention in this specification.

(1) Physical properties determined by X-ray diffraction, preferred orientation parameter (HWHM), crystallite size (Lc(002)), and interlayer spacing (d002):

A bundle of carbon fibers stretched tight is irradiated with X-rays from a direction perpendicular to a plane including the bundle of fibers. In detecting the X-rays transmitted and diffracted by the bundle of fibers by means of a detector, the detector is fixed in the direction in which a signal corresponding to (002) plane becomes maximum. When the bundle of fibers is then rotated in the plane perpendicular to the incident X-rays while fixing the direction of the incident X-rays and the detector, the signal intensity detected by the detector becomes a periodic function with a period of 180° of the rotation angle of the fibers, and has one peak at intervals of 180°. The value of one-half of the full width at half maximum (HWHM) of the peak is called "preferred orientation parameter".

According to "Gakushin-ho" carbon fibers are powdered, and mixed with silicon powder for X-ray diffraction measurement. The interlayer spacing (d002) of graphite crystallite of the carbon fibers was calculated from the position of the peak corresponding to (002) plane. The thickness of laminate of the graphite crystallite (Lc(002)) was calculated from the full width at half maximum of this peak.

The preferred orientation parameter (HWHM) indicates how regularly graphite crystallite are aligned along to the fiber axis, and (d002) and (Lc(002)) are general indexes of the degree of graphitization of carbon fibers. The smaller value of (d002) and the larger value of (Lc(002)) indicate the higher degree of graphitization of carbon fibers.

(2) Magnetoresistance:

Magnetoresistance is usually represented by $\Delta\rho/\rho$ and defined by the equation (1) (magnetoresistance being dimensionless and expressed in terms of percentage):

$$\Delta\rho/\rho = (\rho(\vec{B}) - \rho(O))/\rho(O) \quad (1)$$

wherein $\rho(\vec{B})$ is the electrical resistivity of a sample in the case when a magnetic field having a magnetic flux density of $\vec{B}$ is applied to the sample, and $\rho(O)$ is the electrical resistivity of the sample in the case where no magnetic field is applied.

Magnetoresistance $\Delta\rho/\rho$ increases with an increase of the degree of graphitization of carbon fiber. Magnetoresistance is characterized in that it is not influenced by the shape and size of sample and is independent of the presence of relatively large defects, and therefore it is one of physical property most suitable for evaluating the degree of graphitization of carbon fibers. Further, magnetoresistance is sensitive in regions where the degree of graphitization of carbon fiber is high, and in these regions, all physical property values determined by X-ray diffraction become insensitive, so that magnetoresistance is particularly useful.

The magnetoresistance shown in the explanation of this invention were measured by applying a magnetic field of 10KG to a sample, a tightly stretched bundle of 40 or more carbon fibers, in a direction perpendicular to the sample at liquid nitrogen temperature, when the conditions are not specially mentioned.

(3) Tensile strength, Young's modulus, and elongation:

Tensile strength were evaluated by the resin impregnated strand method shown in JIS R7601. As to elongation, true elongation was measured by attaching an extensometer to a sample. Tensile strength was determined from a load at break. Young's modulus was determined by drawing a line tangent to the linear portion of a load-elongation curve, followed by calculation from the ratio of an increment of load to an increment of elongation. The Young's modulus thus determined is the true one. On the other hand, when a tensile test is carried out by using single filament, the apparent elongation of the single filament is larger than the true one so that its Young's modulus was determined to be smaller than the true one. For example, when a test was carried out by the resin-pregnated strand method by attaching an extensometer to a sample and the Young's modulus of the sample was determined to be 55 ton·mm$^{-2}$, the Young's modulus determined by subjecting the same sample to a tensile test using single filament was 40 ton·mm$^{-2}$.

(4) Viscosity and softening point:

Viscosity was determined by use of a flow tester and calculator from Hagen-Poiseuille's equation. Softening point is a temperature at which viscosity becomes 20,000 poises.

(5) Mesophase content:

The term "mesophase" used herein means a portion having optical anisotropy which can be determined by embedding a cooled and solidified pitch in a resin or the like, polishing its surface, and observing the surface under a reflecting polarization microscope. The term "mesophase content" means the area percentage of the anisotropic portion observed in the manner described above.

The following comparative example and examples serve to illustrate this invention in more detail. In the comparative example and examples, all percentages but magnetoresistance and mesophase content are by weight.

EXAMPLE 1

A coaltar pitch having a softening point of 80° C. as a starting material and tetrahydroquinoline as a solvent for hydrogenation were reacted under a pressure of 120 kg·cm$^{-2}$ at 440° C. for 18 minutes. Then the solvent and low-boiling distillates were removed under reduced pressure at 270° C. to obtain hydrogenated pitch. The hydrogenated pitch was heat-treated at 470° C., at atmospheric pressure for 42 minutes, after which low-boiling distillates were removed under reduced pressure at 480° C. to obtain a mesophase pitch. The mesophase pitch had a softening point of 308° C., TI of 90.8%, QI of 19.8%, and a mesophase content of 100%.

The aforesaid mesophase pitch was placed in a spinning nozzle equipped with a stirrer, heated to 355° C. at a temperature elevation rate of 10° C.·min$^{-1}$, and maintained at this temperature for 30 minutes. Then, while stirring the resulting molten pitch by rotating the stirrer it 27 r.p.m., the molten pitch was extruded at a rate of 0.06 g·min$^{-1}$ by applying a pressure by use of nitrogen gas, and stretched at the speed of 500 m·min$^{-1}$ to obtain pitch fibers. The spinning was conducted by setting the tip of the stirrer close to the extrusion opening of nozzle (about 2 mm above the extrusion opening).

The pitch fiber thus obtained was observed under a reflecting polarization microscope to find that its cross-section structure was of random type.

The pitch fiber obtained was heated from 200° C. to 300° C. in air at a temperature elevation rate of 0.5° C.·min$^{-1}$, maintained at 300° C. for 1 hour, and was infusible. Then, it was heated to 2,500° C. in argon gas at a temperature elevation rate of 50° C.·min$^{-1}$ and heat-treated for 15 minutes to obtain carbon fiber.

The section structure in a direction perpendicular to the fiber axis of the carbon fiber thus obtained was observed by use of a reflecting polarization microscope and a scanning electron microscope to find that it was of random type.

The carbon fiber had a preferred orientation parameter (HWHM) of 8.4°, a crystallite size (Lc(002)) of 20 nm and an interlayer spring (d002) of 0.339 as determined by X-ray diffraction, and a magnetoresistance ($\Delta\rho/\rho$) of −0.401%. This fiber was flexible.

It had a tensile strength of 270 kg·mm$^{-2}$, Young's modulus of 67 ton·mm$^{-2}$, and an elongation of 0.40%.

EXAMPLE 2

The same mesophase pitch as used in Example 1 was placed in the same spinning nozzle equipped with a stirrer as in Example 1, heated to 355° C. at a temperature elevation rate of 10° C.·min$^{-1}$, and maintained at this temperature for 30 minutes. Then, while rotating the stirrer at 17.8 r.p.m., the resulting molten pitch was extruded at a rate of 0.06 g·min$^{-1}$ by applying a pressure by use of nitrogen gas, and stretched at a speed of 500 m·min$^{-1}$ to obtain pitch fiber. The tip of the stirrer was set at a height of about 7 mm from the extrusion opening of nozzle.

The pitch fiber thus obtained had a cross-section structure of quasi-onion type.

The pitch fiber was made infusible and heat-treated in the same manner as in Example 1 to obtain carbon fiber.

The section structure in a direction perpendicular to the fiber axis was observed by use of a reflecting polarization microscope and a scanning electron microscope to find that it was of quisi-onion type.

The carbon fiber had a preferred orientation parameter (HWHM) of 8.3°, a crystallite size (Lc(002)) of 19 nm, and an interlayer spacing (d002) of 0.339 nm as determined by X-ray diffraction, and a magnetoresistance ($\Delta\rho/\rho$) of −0.432%. This fiber was flexible.

It has a tensile strength of 265 kg·mm$^{-2}$, a Young's modulus of 62 ton·mm$^{-2}$, and an elongation of 0.43%.

EXAMPLE 3

A coaltar pitch having a softening point of 80° C. as a starting material and tetrahydroquinoline as a solvent for hydrogenation were reacted under a pressure of 120 kg·cm$^{-2}$ at 450° C. for 18 minutes. Then, the solvent and low-boiling distillates were removed under reduced pressure at 270° C. to obtain a hydrogenated pitch. The hydrogenated pitch was heat-treated at 460° C. at atmospheric pressure for 60 minutes, after which low-boiling distillates were removed under reduced pressure at 480° C. to obtain a mesophase pitch. The mesophase pitch had a softening point of 318° C., TI of 92.1%, QI of 10.5%, and a mesophase content of 98%. This pitch was placed in the same spinning nozzle equipped with a stirrer as in Example 1, heated to 358° C. at a temperature elevation rate of 10° C.·min$^{-1}$, and maintained at this temperature for 30 minutes. Then, while rotating the stirrer at 9.8 r.p.m., the resulting molten pitch was extruded at a rate of 0.065 g·min$^{-1}$ by applying a pressure by use of nitrogen gas, and stretched at a speed of 500 m·min$^{-1}$ to obtain pitch fiber. The tip of the stirrer was set at a height of about 10 mm from the discharge opening of nozzle.

The pitch fiber thus obtained was observed under a reflecting polarization microscope to find that its cross-section structure was of quasi-onion type.

The pitch fiber was made infusible and heat-treatment in the same manner as in Example 1 to obtain carbon fiber.

As a result of observation using a reflecting polarization microscope and a scanning electron microscope, the cross-section structure of the carbon fiber obtained was found to be of quasi-onion type.

The carbon fiber had a preferred orientation parameter (HWHM) of 7.5°, a crystallite size (Lc(002)) of 23 nm and an interlayer spacing (d002) of 0.339 as determined by X-ray diffraction, and a magnetoresistance ($\Delta\rho/\rho$) of −0.415%. This fiber was flexible.

It had a tensile strength of 333 kg·mm$^{-2}$, a Young's moldulus of 87 ton·mm$^{-2}$, and an elongation of 0.38%.

COMPARATIVE EXAMPLE

The same mesophase pitch as used in Example 1 was placed in a conventional spinning nozzle, heated to 355° C. at a temperature elevation rate of 10° C.·min$^{-1}$, and maintained at this temperature for 30 minutes, after which the mesophase pitch melted was extruded from a nozzle at a rate of 0.06 g·mm$^{-1}$ by applying a pressure by use of nitrogen gas, and streched at a speed of 500 m·min$^{-1}$ to obtain pitch fiber.

The pitch fiber thus obtained was observed under a reflecting polarization microscope to find that its cross-section structure was of radial type.

The pitch fiber was made infusible and heat-treated in the same manner as in Example 1 to obtain carbon fiber.

As a result of observation using a reflecting polarization microscope and a scanning electron microscope, the cross-section structure of the carbon fiber thus obtained was found to be of radial type, and there were observed a large number of fibers having splits along the fiber axis direction. The carbon fiber was so brittle that it was easily broken by handling. The carbon fiber obtained had a preferred orientation parameter (HWHM) of 9.6°, a crystallite size (Lc(002)) of 32 nm and so interlayer spacing (d002) of 0.337 as determined by X-ray diffraction, and a magnetoresistance ($\Delta\rho/\rho$) of +0.455%.

It had a tensile strength of 190 kg·mm$^{-2}$, a Young's modulus of 69 ton·mm$^{-2}$, and an elongation of 0.28%.

The carbon fiber of this invention obtained by using as precursor material mesophase pitch obtained from coaltar pitch has a high modulus of elasticity, is flexible, and does not split in the fiber axis direction, and therefore it is easy to handle, is good in workability, and contributes also to improvement of the production efficiency.

Further, when the carbon fiber of this invention is used in composite material, the resulting composite material can be expected to have an improved impact strength and hence can be used for various purposes.

What is claimed is:

1. A carbon fiber having a high Young's modulus produced by using coaltar pitch as a starting material, which has a microstructure with a preferred orientation parameter (HWHM) (expressed as the half maximum at half width) of 10° or less as determined by X-ray analysis, a crystallite size (Lc(002)) of not more than 25 nm and not less than 18 nm and an interlayer spacing (d002) of not more than 0.345 nm and not less than 0.338 nm as determined by X-ray diffraction, and has a magnetoresistance of less than −0.40% and not less than −2.00% as measured by applying a magnetic field of 10KG perpendicularly to the fiber axis at liquid nitrogen temperature, and a Young's modulus of 55 ton·mm$^{-2}$ or more.

2. A carbon fiber according to claim 1, which has a tensile strength of 250 kg·mm$^{-2}$ or more.

3. A carbon fiber according to claim 1, which has a Young's modulus of 75 ton·mm$^{-2}$ or more.

4. A carbon fiber according to claim 1, wherein in its section in a direction perpendicular to the fiber axis, domains where molecules are aligned in the same direction are distributed drawing a swirl in the manner of coaxial circles.

5. A carbon fiber according to claim 4, which has a Young's modulus of 75 ton·mm$^{-2}$ or more.

6. A carbon fiber according to claim 1, wherein in its section in a direction perpendicular to the fiber axis, domains where molecules are aligned in the same direction are distributed at random.

7. A carbon fiber according to claim 6, which has a Young's modulus of 75 ton·mm$^{-2}$ or more.

* * * * *